US007004312B2

(12) United States Patent
Chen

(10) Patent No.: US 7,004,312 B2
(45) Date of Patent: Feb. 28, 2006

(54) ALUMINUM BUSINESS CARD BOX

(76) Inventor: Hsin Wang Chen, 2F, No.2, Lane 595, Jhongyi Rd., Gueishan Township, Taoyuan County 333 (TW)

( * ) Notice: Subject to any disclaimer, the term of this patent is extended or adjusted under 35 U.S.C. 154(b) by 271 days.

(21) Appl. No.: 10/689,714

(22) Filed: Oct. 22, 2003

(65) Prior Publication Data

US 2005/0087454 A1 Apr. 28, 2005

(51) Int. Cl.
*A45C 11/18* (2006.01)

(52) U.S. Cl. ..... 206/39.5; 206/232; 206/555; 206/815; 221/232; 221/268; 312/330.1; 220/345.3

(58) Field of Classification Search ..... 206/37, 206/38, 39, 39.5, 232, 449, 555, 804, 815; 220/345.2, 345.3; 312/330.1, 333, 348.1, 312/348.4, 234.3; 221/232, 268, 279, 255
See application file for complete search history.

(56) References Cited

U.S. PATENT DOCUMENTS

| | | | | |
|---|---|---|---|---|
| 3,888,350 | A * | 6/1975 | Horvath | 206/531 |
| 4,561,544 | A * | 12/1985 | Reeve | 206/540 |
| 5,080,222 | A * | 1/1992 | McNary | 206/1.5 |
| 5,275,291 | A * | 1/1994 | Sledge | 206/531 |
| 2002/0139802 | A1 * | 10/2002 | Cross | 220/345.2 |

* cited by examiner

*Primary Examiner*—David T. Fidei
(74) *Attorney, Agent, or Firm*—Birch, Stewart, Kolasch & Birch, LLP

(57) ABSTRACT

An aluminum business card box comprises a main box and a drawer box. A top cover is on the top of the main box and a containing slot is arranged in the middle part thereof. The inserting slot accommodates the ID badge. And a drawer cover is on one end of the drawer box to forms a space for business cards to store in. Users can insert ID badge into the main box and have business cards stored in the drawer box.

1 Claim, 5 Drawing Sheets

ALUMINUM BUSINESS CARD BOX

BACKGROUND OF THE INVENTION

I. Field of the Invention

This invention relates generally to a business card box and, more specifically, to an aluminum business card box that consists of a main box and a drawer box, the drawer box is installed inside the main box, users can insert ID badge into the main box and have business cards in the drawer box.

II. Description of the Prior Art

Heretofore, it is known that most of the business card boxes are made of plastic or acrylic materials, when business cards are out, those boxes are thrown away directly, however plastic and acrylic will not disassemble easily, they cause environment hazard. If the application of plastic material is reduced, the impact to environment is lower. Most people have the business cards in their wallets or business card holders, men usually have wallets or business card holders in their pockets, and women have that in their purse or handbag, they have to take wallets or business card holders from pockets or purses, and then take the business cards from wallets or business card holders, that is not very convenient.

Most of the employees of a large company or in a big building must have ID badge, most of the badges are fixed on clothes with a clip or worn on neck with a string; those employees also have to carry many other items on their way to office, such as business cards and the badge mentioned above, these items might cause troublesome and inconvenience.

SUMMARY OF THE INVENTION

It is therefore a primary object of the invention to provide an aluminum business card box comprising a main box and a drawer box, an ID badge can be placed inside the main box, and business cards can be stored inside the drawer box.

In order to achieve the objective set forth, an aluminum business card box in accordance with the present invention comprises a main box and a drawer box. A "T" shape bar each on both edges of the largest side, an inserting slot is between the two "T" shape bars, the inserting slot accommodates the ID badge; a left fastening hole and a right fastening hole are on both sides of the main box; a top cover is on the top of the main box, a hanging hole is on one side of the main box, a hanging string passes through the hanging hole. The drawer box is placed inside the containing slot of the main box; the cross section of the drawer box is in "U" shape, a drawer cover is on one end of the drawer box and forms a space, business cards are stored inside the space; a spring with a protruding point is on one side of the drawer box, the drawer box is fastened to the main box by the protruding point fastened to the left fastening hole or the right fastening hole; two oblique guide slices are inside the drawer box, a through hole is on the bottom of the drawer box, when users pull the drawer box out, they can use a finger to push one business card up and pull the business card out along the oblique guide slice. Users can insert ID badge into the main box and have business cards in the drawer box

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
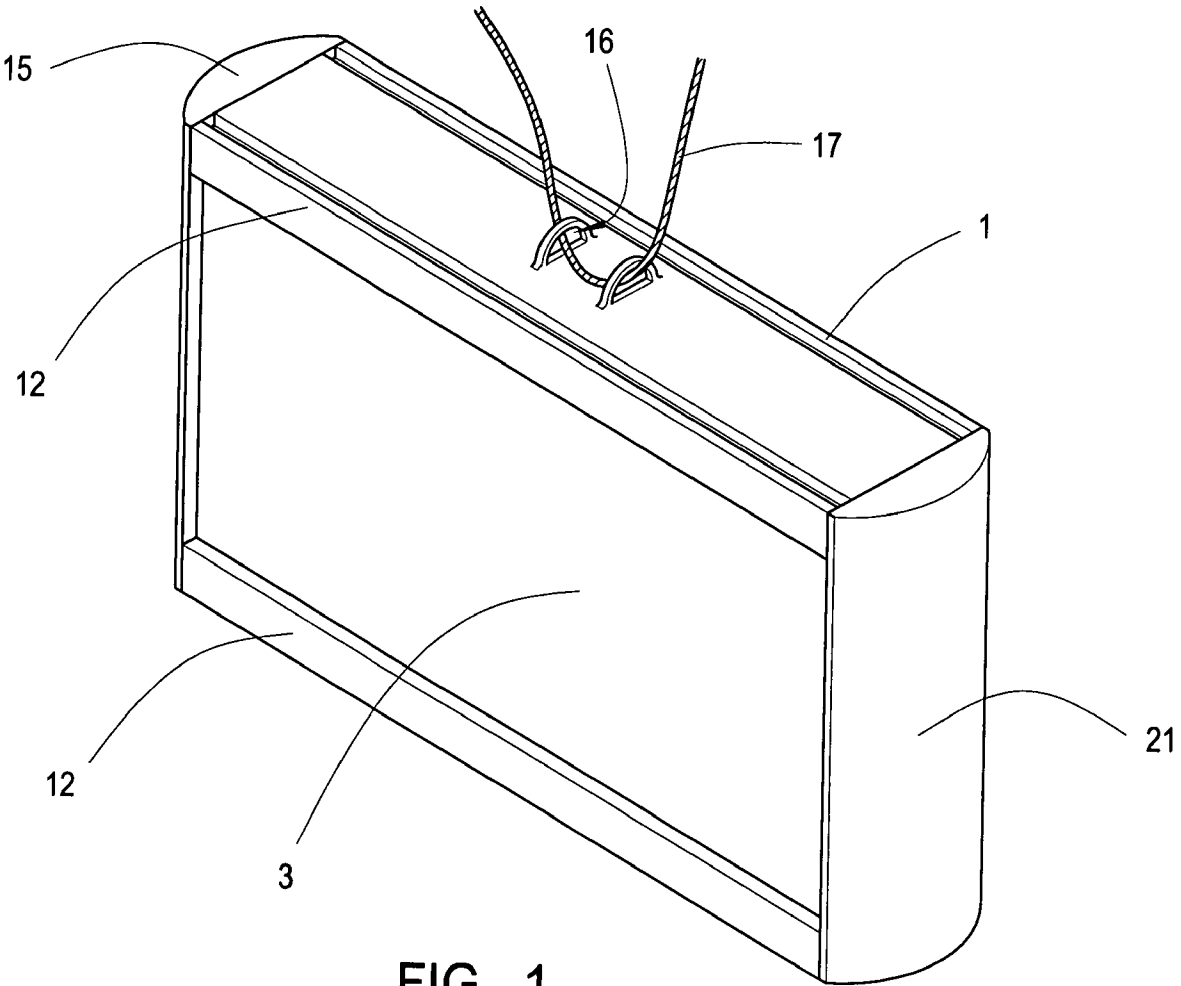
FIG. 1 is a perspective view of the present invention.
Figure 2:
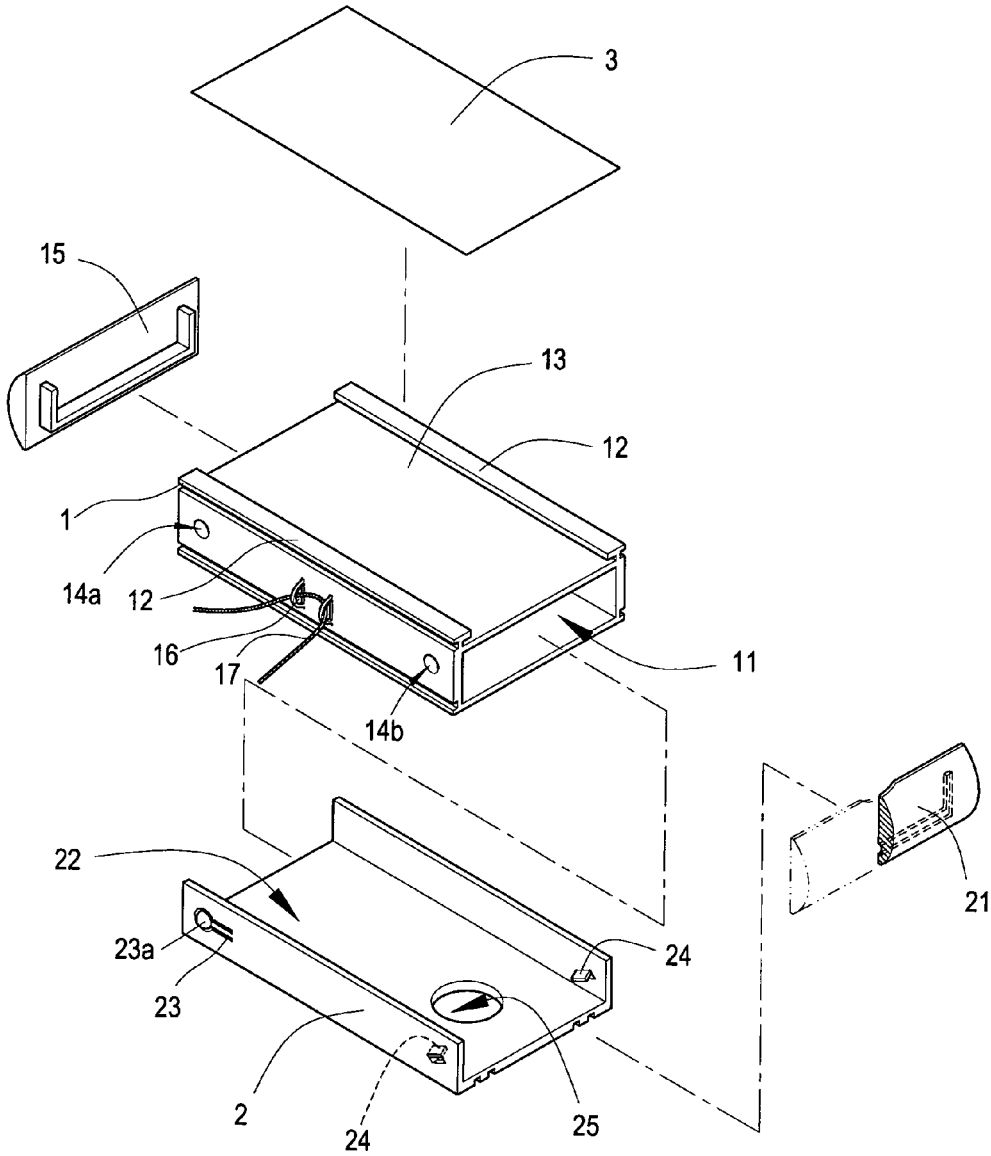
FIG. 2 is an assembly view of the present invention.

Referring to FIG. 1 and FIG. 2, the present invention is composed of a main box 1, and a drawer box 2. The functions of each component are described below:

A "T" shape bar 12 each is on both edges of the largest side of the main box 1, an inserting slot 13 is between the two "T" shape bar 12, the inserting slot 13 can accommodate the ID badge 3; a left fastening hole 14*a* and a right fastening hole 14*b* are on both sides of the main box 1; a top cover 15 is on the top of the main box 1; a hanging hole 16 is on one side of the main box 1, a hanging string 17 passes through the hanging hole 16.

Figure 3:
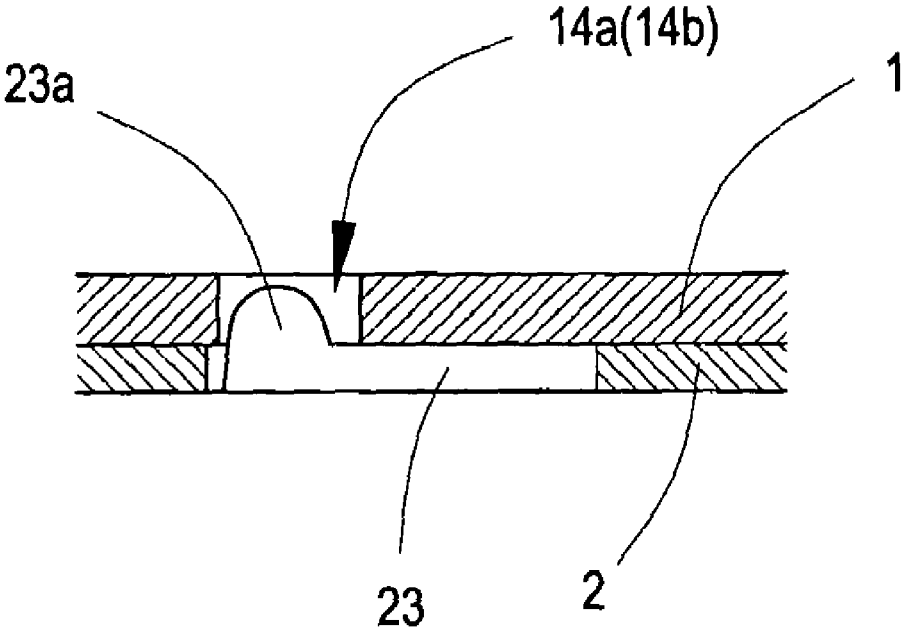
FIG. 3 is a cross section view of a further embodiment of the present invention.
Figure 4:
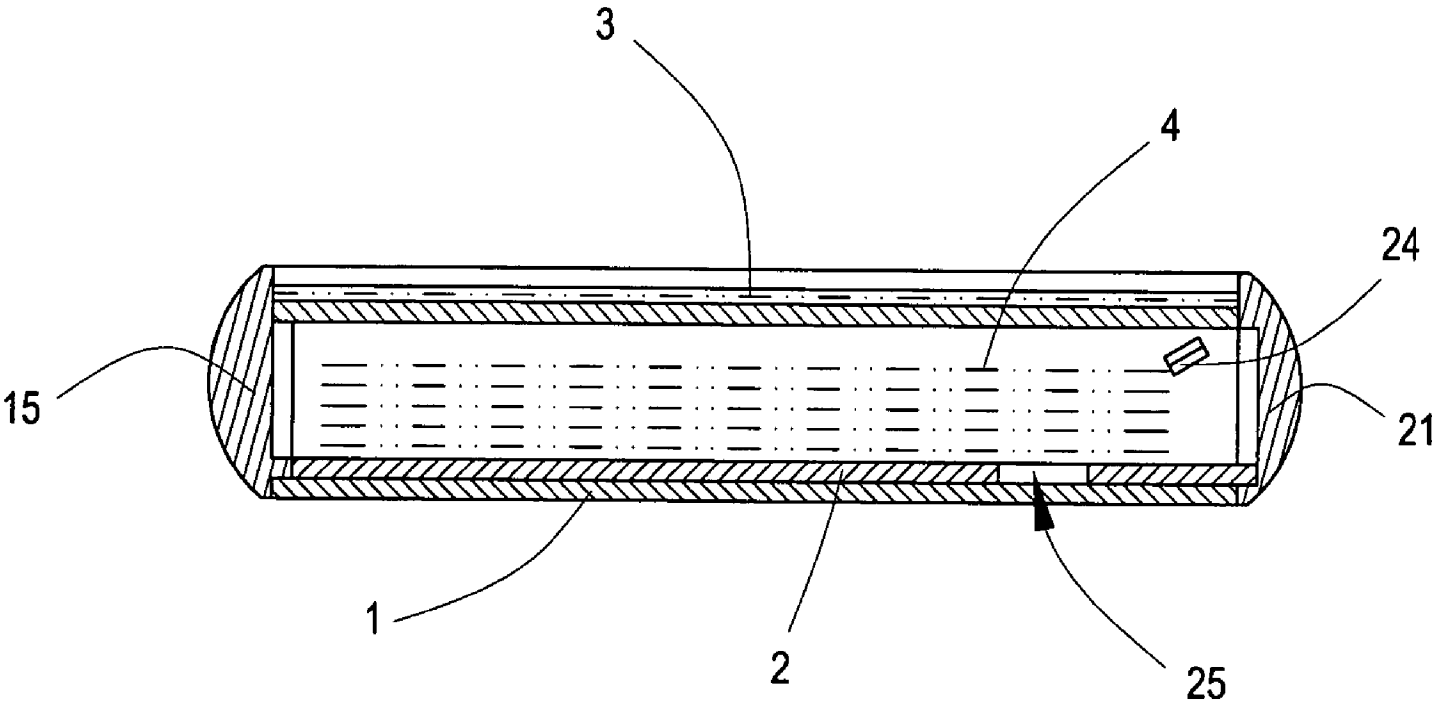
FIG. 4 is a cross section view of another embodiment of the present invention.

The drawer box 2 is placed inside the containing slot 11 of the main box 1, the cross section of the drawer box 2 is in "U" shape; a drawer cover 21 is on one end of the drawer box 2 and forms a space 22, business cards 4 are stored inside the space 22; a spring 23 with a protruding point 23*a* is on one side of the drawer box 2, as shown in FIG. 3, the drawer box 2 is fastened to the main box 1 by the protruding point 23*a* fastened to the left fastening hole 14*a* or the right fastening hole 14*b*. Referring to FIG. 4, two oblique guide slice 24 are inside the drawer box 2, a through hole 25 is on the bottom of the drawer box 2, when users pull the drawer box 2 out, they can use a finger to push one business card 4 up and pull the business card 4 out along the oblique guide slice 24.

Based on structure describe above, users can pull the drawer box 2 from the containing slot 11 of the main box 1, then insert the ID badge 3 into the main box 1 from the inserting slot 13, and place business card 4 into the space 22 of the drawer box 2; as shown in FIG. 3 and FIG. 4, when the drawer box 2 is pushed into the containing slot 11 of the main box 1, the protruding point 23*a* of the spring 23 on one side of the drawer box 2 is fastened by the left fastening hole 14*a* of the main box 1 to fix the drawer box 2 inside the main box 1 and avoid the drawer box 2 from sliding out; users can fix the ID badge 3 to the inserting slot 13 of the main box 1 with the top cover 15 on the top of the main box 1 and the drawer cover 21 of the drawer box 2.

When users pull the drawer box 2 out, the protruding point 23*a* of the spring 23 is fastened by the right fastening hole 14*b* of the main box 1 to have the drawer box 2 fix.

Figure 5:
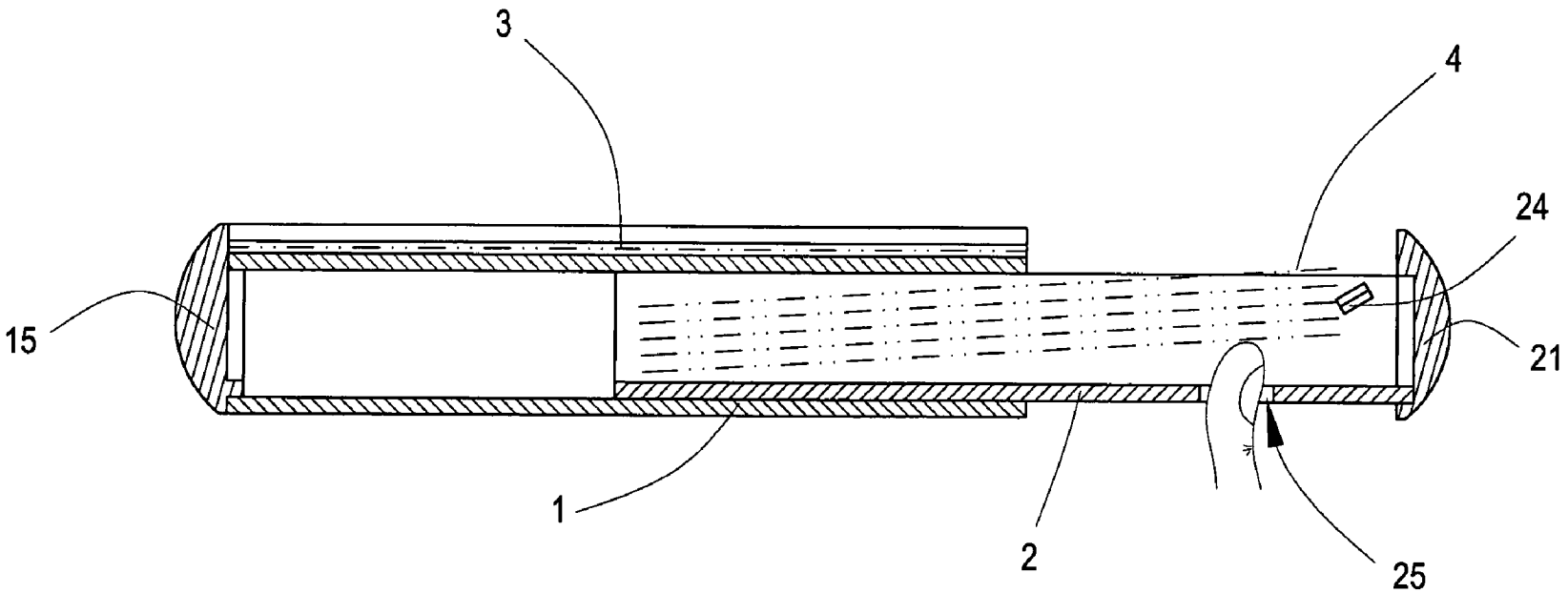
FIG. 5 is an application view in accordance with the present invention.

When users want to take business card 4, they can pull the drawer box 2 out and push up the through hole 25 on the bottom of the drawer box 2 with finger to push the business card 4 inside the drawer box 2 out, the business card 4 is on the oblique guide slice 24 on two sides of the drawer box 2, as shown in FIG. 5, users now can pull the business card 4 out easily.

The drawer box 2 is inside the containing slot 11 of the main box 1, and the ID badge 3 is inside the inserting slot 13 on the largest side of the main box 1, the space 22 of the drawer box 2 is for business card 4, users can carry the main box 1 with the hanging string 17 to have the ID badge 3 on and easy access of the business card 4.

While a preferred embodiment of the invention has been shown and described in detail, it will be readily understood and appreciated that numerous omissions, changes and additions may be made without departing from the spirit and scope of the invention.

What is claimed is:

1. An aluminum business card box comprising:

a main box with a "T" shape bar each on both edges of a largest side, an inserting slot is between two said "T" shape bars, said inserting slot accommodates an ID badge, a left fastening hole and a right fastening hole are on both sides of said main box, a top cover is on the top of said main box, a hanging hole is on one side of said main box, a hanging string passes through said hanging hole;

a drawer box is placed inside said containing slot of said main box, the cross section of said drawer box is in "U" shape, a drawer cover is on one end of said drawer box and forms a space, business cards are stored inside said space, a spring with a protruding point is on one side of said drawer box, said drawer box is fastened to said main box by said protruding point fastened to said left fastening hole or said right fastening hole, two oblique guide slices are inside said drawer box, a through hole is on a bottom of said drawer box, when users pull said drawer box out, they can use a finger to push one business card up and pull the business card out along said oblique guide slice.

* * * * *